US005829161A

United States Patent [19]

Hung et al.

[11] Patent Number: 5,829,161

[45] Date of Patent: Nov. 3, 1998

[54] ELECTROTHERMAL DRYING RACK

[76] Inventors: Chichuan Hung; Shu-Fen Lee, both of 10th FL-14, No. 186, Nanking East Rd., Sec. 4, Taipei, Taiwan

[21] Appl. No.: 666,704

[22] Filed: Jun. 18, 1996

[30] Foreign Application Priority Data

Jul. 11, 1995 [CN] China ..... 95 2 16026.9

[51] Int. Cl.[6] ..... F26B 19/00

[52] U.S. Cl. ..... 34/202; 34/233; 34/239

[58] Field of Search ..... 34/60, 61, 103, 34/104, 106, 107, 176, 177, 201, 202, 218, 233, 239; 219/400; 392/379; 211/88.04, 133.6; 248/316.3, 316.5, 316.7

[56] References Cited

U.S. PATENT DOCUMENTS 4,324,337 4/1982 Hermalahti ..... 211/88.04
4,471,537 9/1984 Meda ..... 34/77
4,856,206 8/1989 Klein ..... 34/619
4,927,995 5/1990 Lovet et al. ..... 219/385
5,555,640 9/1996 Ou ..... 34/202

*Primary Examiner*—Henry A. Bennett
*Assistant Examiner*—Steve Gravini
*Attorney, Agent, or Firm*—Pro-Techtor International Services

[57] ABSTRACT

An electrothermal drying rack including a main support, a retaining cover pivotally connected with the main support and a heating tube disposed in the retaining cover. Ventilating devices such as fans are disposed on the main support. The retaining cover serves to firmly secure and protect the heating tube and mount the drying rack on a wall face. The retaining cover defines a half-closed air passage and the fans forcedly guide and speed the air flow through the air passage so as to enhance the drying effect.

19 Claims, 8 Drawing Sheets

ELECTROTHERMAL DRYING RACK

BACKGROUND OF THE INVENTION

The present invention relates to an electrothermal drying rack including a main support and a retaining cover pivotally connected therewith and defining a half-closed air passage around the heating tube. The retaining cover serves to firmly secure and protect the heating tube. Ventilating devices are disposed on the main support to forcedly guide and speed the air flow through the air passage so as to enhance the drying effect.

A conventional towel rack only provides a simple beam member for hanging a towel thereon to be naturally dried. Such towel rack lacks any drying device for speeding the evaporization of the water contained in the towel. As a result, the towel in a wet state for a long term is subject to perforation due to damage of fiber tissure and may lead to undesired odor. Therefore, a drying rack which is able to quickly dry the towel is developed to solve the above problems. Taiwanese Patent Application Nos. 78202917 and 83200381 are examples of such drying rack. FIG. 1 shows the former in which several heat-conducting tubes are inserted in a top face of a metalic support seat. A front heat-insulating shade and a rear heat-insulating board are fastened to the front and rear sides of the support seat. A thermostat switch, a power lead hole and an indicator lamp are disposed under the front heat-insulating shade. Heating plates are disposed between the support seat and the heat-insulating board for conducting heat through the support seat to the heat-conducting tubes. The semi-cylindrical support seat can be secured on a wall by means of a fixing seat and the towel can be hung on the heat-conducting tubes to be quickly dried.

According to the above structure, the support seat actually occupies most of the volume of the drying rack. For a relatively small towel, such dimension of the drying rack is able to achieve the drying effect to a certain extent. However, with respect to a relatively large bath towel, such drying rack can hardly fully dry the towel. Moreover, such drying rack includes multiple separate complicated components and is not designed as a close pattern so that the internal electric elements are subject to corrosion due to the humidity in the bath room.

In order to eliminate the above shortcomings existing in the above prior art, a towel drying rack as shown in FIG. 2 is developed, wherein an elongated main support is provided, including arch seat bodies respectively at upper and lower ends. An angled sleeve is fitted in the upper seat body and a support rod is fitted between the angled sleeve and the lower seat body. Two connecting sleeves are connected to the middle and lower portions of the support rod for coupling a C-shaped heating tube with the support rod. A hanging beam is horizontally fitted in the angled sleeve, whereby a towel can be hung on the hanging beam to be dried by the heating tube.

When mounted on a wall, the main support of such towel drying rack is secured on the wall by screws passing through thread holes thereof. The thread holes are formed behind the support rod so that it is quite inconvenient to fasten the screws. The main support must be first secured on the wall by screws and then the angled sleeve and support rod, etc. are assembled with the main support. The assembling procedure is quite complicated. Moreover, the angled sleeve and the connecting sleeves are respectively assembled with the support rod, hanging beam and heating tube. Such procedure is quite troublesome. Therefore, Taiwanese Patent Application No. 83200381 provides an improved towel drying rack as shown in FIG. 3, which has simplified components and can be more easily assembled to form a close structure. This towel drying rack includes a close main support, a fixing board pivotally connected with two ends thereof and a single continuously curved heating tube connected with the main support. The electric heating elements are contained in the close main support. According to such arrangement, the components of the drying rack is simplified and can be easily assembled. Also, the main support can be rotated left and right through 90 degrees so that the fixing board can be easily secured on a wall by screws.

However, the prior art as shown in FIG. 3 still has the following disadvantages in practical use:

1. The heating tube is disposed on the main support which is pivotally connected with the fixing board. This permits the heating tube and the main support to be freely rotated to a suitable position for easily hanging or taking the towel or articles to be dried. However, this also makes it possible that the heating tube undesirably extends outward. In a narrow place, the heating tube may be collided and damaged by external articles. Even more, the user may touch the heating tube and get injured thereby.
2. The article hung on the drying rack is simply dried by the heating effect of the heating tube. The ambient space around the heating tube is completely open and no ventilating device for forcing the air flow is provided so that the air flows at a slow speed. It is known that the drying effect is related to both the heating effect and the convection of air. Therefore, in case the air flow around the drying rack is speeded, the drying effect can be enhanced and more unified rather than concentrated in the area contacting with the heating tube.
3. The prior drying rack is only equipped with a thermostat switch for controlling the heating temperature, while lacking any heating time setting switch. Therefore, it is impossible to control the heating time during absence of the user and thus some energy may remain and be wasted after the drying procedure.

SUMMARY OF THE INVENTION

It is a primary object of the present invention to provide an electrothermal drying rack including a main support and a retaining cover pivotally connected therewith and defining a half-closed air passage around the heating tube. The retaining cover serves to firmly secure and prevent the heating tube from unexpectedly extending outward so as to avoid injury of the user.

It is a further object of the present invention to provide the above drying rack in which ventilating devices are disposed on the main support to forcedly guide and speed the air flow through the air passage so as to enhance the drying effect and save power.

It is still a further object of the present invention to provide the above drying rack in which a thermostat controlling switch and a drying time setting switch are disposed in the main support for controlling the heating temperature and heating time so as to avoid waste of energy.

The present invention can be best understood through the following description and accompanying drawings, wherein:

DETAILED DESCRIPTION OF THE PREFERRED EMBODIMENTS

Figure 1:
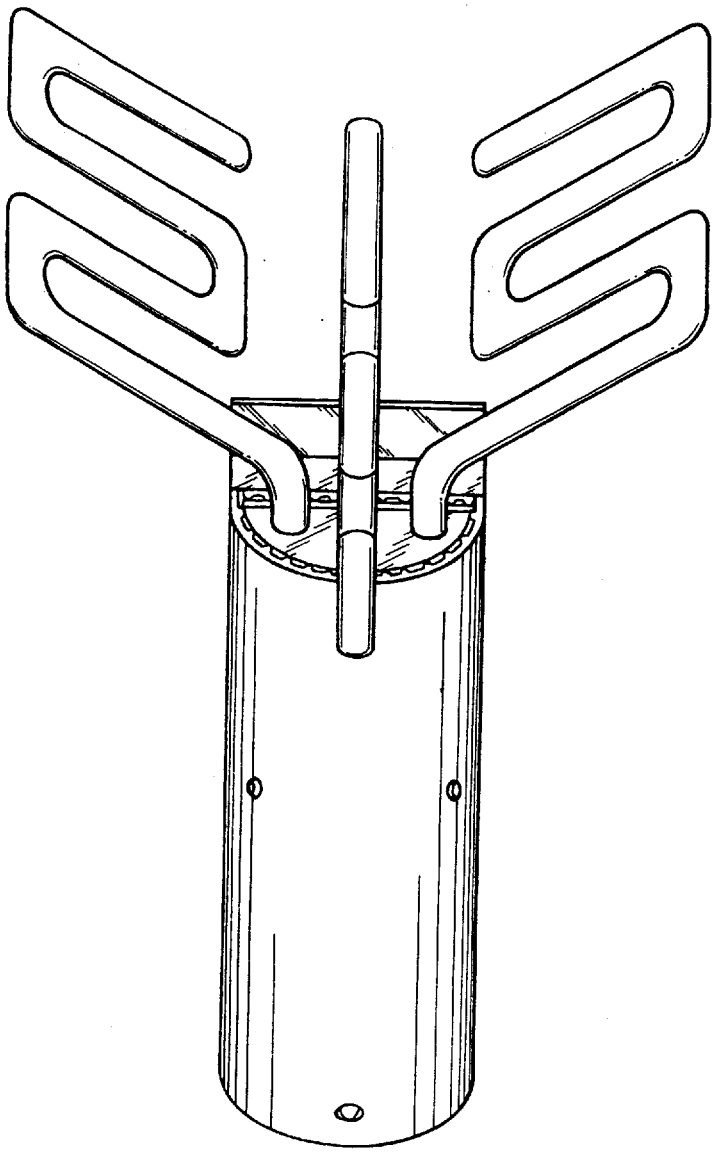
Fig. 1 PRIOR ART
FIG. 1 is a perspective view of a conventional towel drying rack disclosed in Taiwanese Patent Application No. 78202917.
Figure 2:
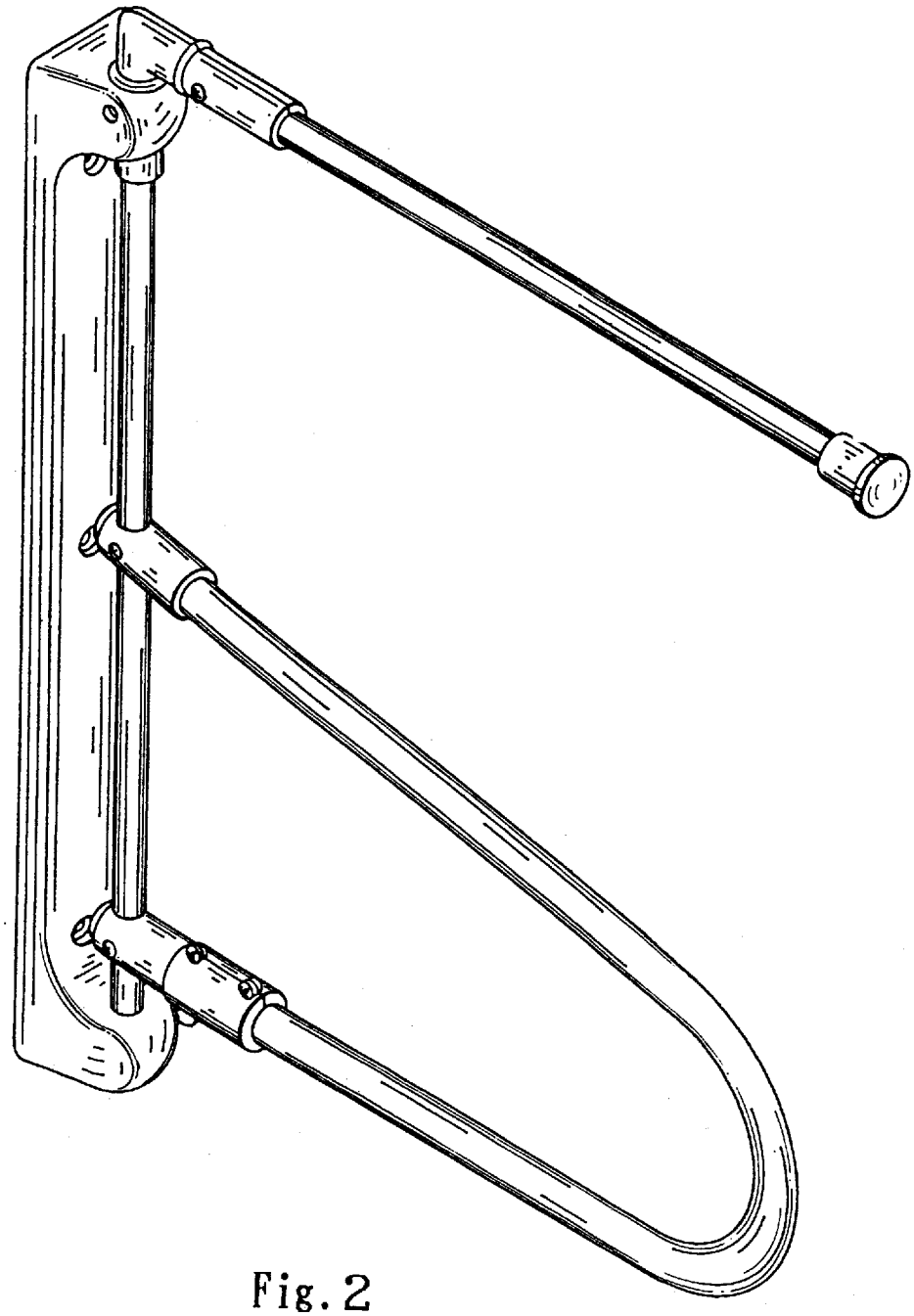
Fig. 2 PRIOR ART
FIG. 2 is a perspective view of another conventional towel drying rack.
Figure 3:
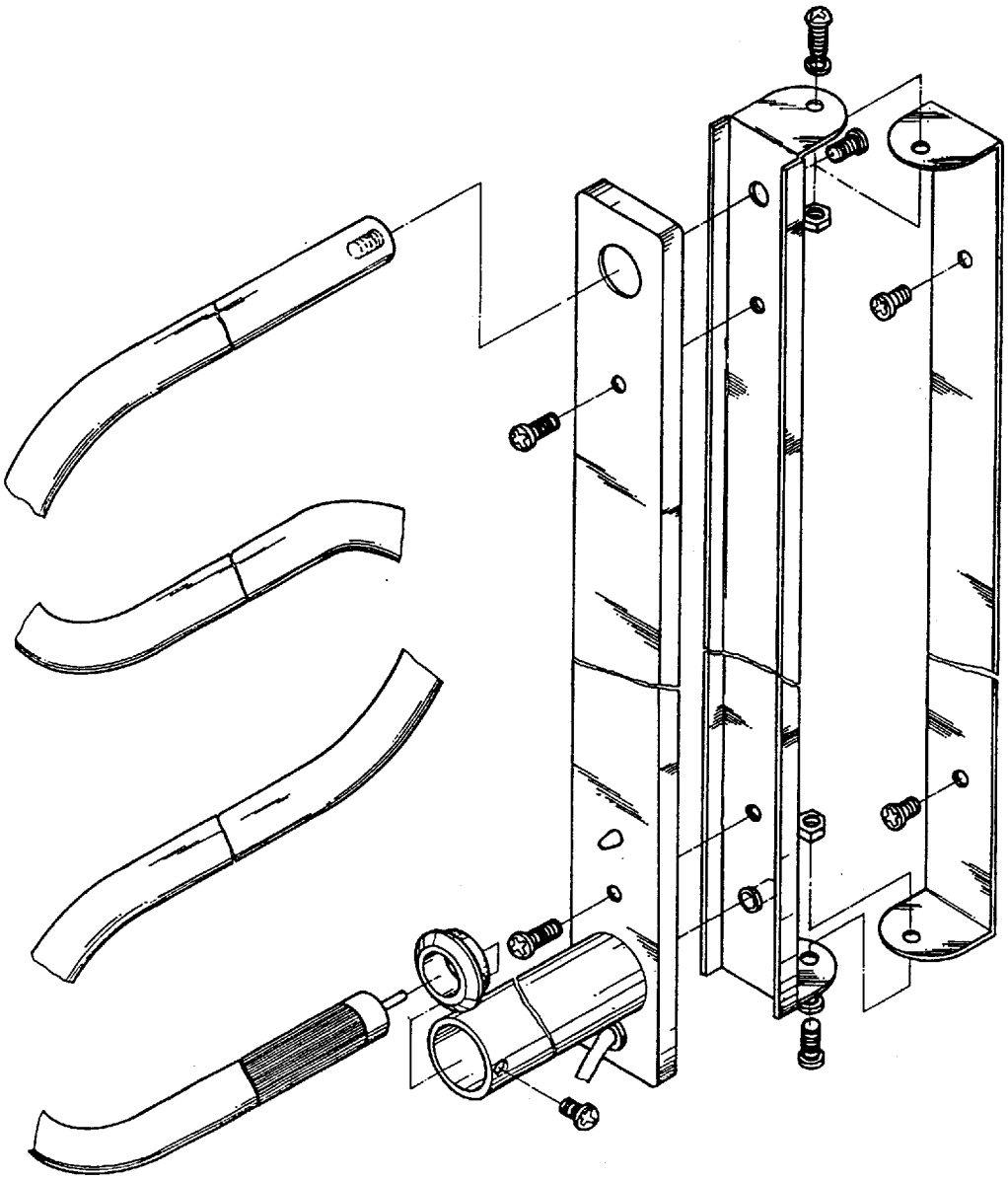
Fig. 3 PRIOR ART
FIG. 3 is a perspective exploded view of still another conventional towel drying rack disclosed in Taiwanese Patent Application No. 83200381.

Please refer to FIGS. 4 to 8. The present invention includes a main support 10, a fixing board 20, a heating tube 30 and a retaining cover 40.

The main support 10 includes a hollow board member 11 having two lugs 12 respectively at upper and lower ends for pivotally connecting with two corresponding lugs 21 of the fixing board 20. The heating tube 30 is disposed on front side of the board member 11 and ventilating devices 13 such as fans are installed on the front side of the board member 11. Hanging hooks 14 are disposed on a lateral side of the board member 11 for connecting with the retaining cover 40. A thermostat controlling switch and a time setting switch (not shown) are disposed on the power source 31 of the heating tube 30 for regulating the heating temperature and heating time according to the natures of the articles to be dried.

The fixing board 20 is formed with two lugs 21 at upper and lower ends respectively for pivotally connecting with the lugs 12 of the main support 10, whereby the main support 10 can be horizontally rotated through a certain angle. The fixing board 20 is disposed with several mounting holes 22 for securing the fixing board 20 on a wall face.

Figure 4:
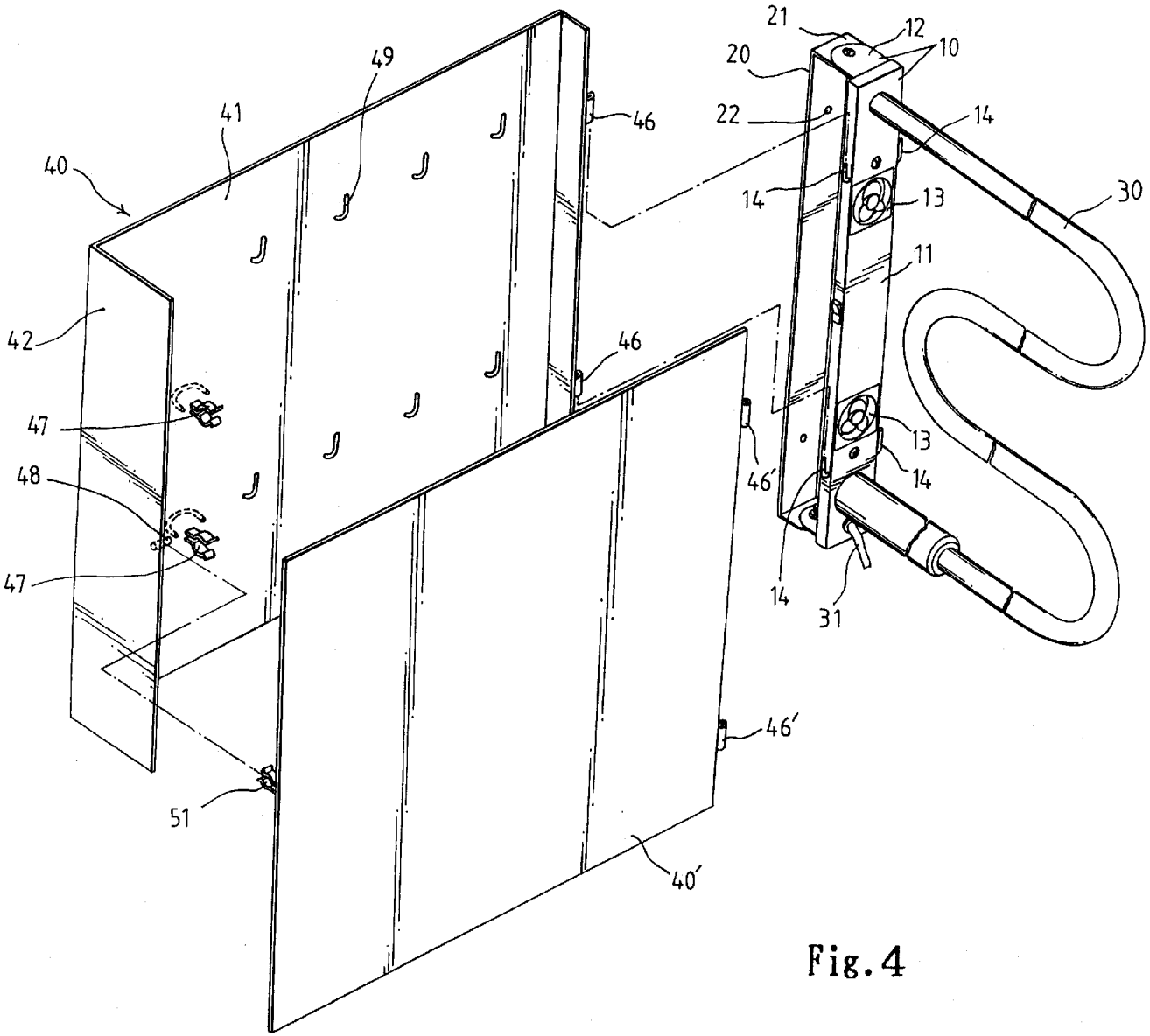
FIG. 4 is a perspective exploded view of a first embodiment of the present invention.
Figure 5:
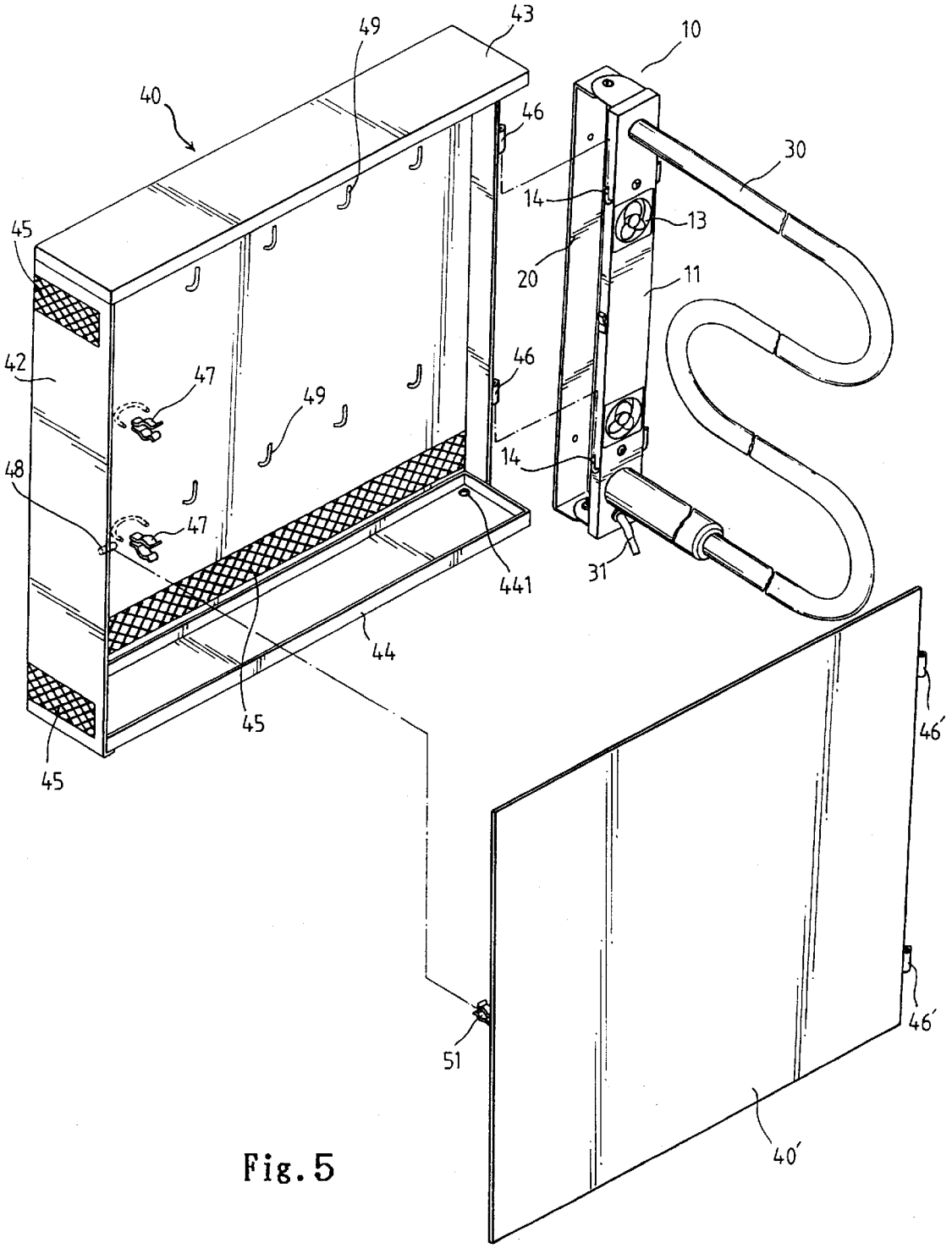
FIG. 5 is a perspective exploded view of a second embodiment of the present invention.
Figure 6:
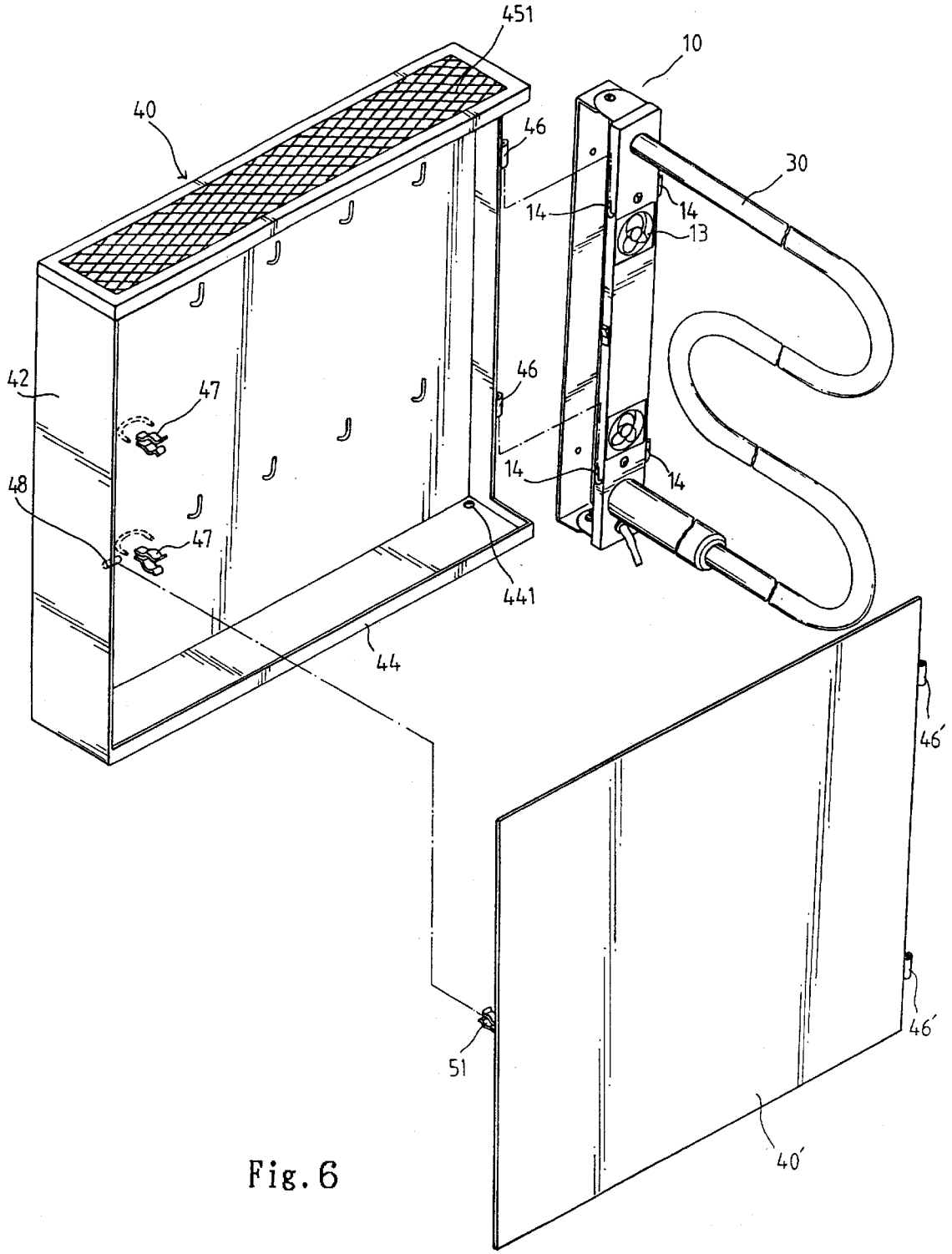
FIG. 6 is a perspective exploded view of a third embodiment of the present invention.

The retaining cover 40 includes a half-closed cover body and a back board 40'. The cover body includes a front face board 41 and a lateral bent board 42 as shown in FIG. 4. A shade board 43 and a water tray 44 can be further disposed on upper and lower sides of the front face board 41 and lateral bent board 42 as shown in FIG. 5. Also, a ventilating window 45 can be disposed on the front face board or lateral bent board. Alternatively, a board member 451 with ventilating window can be disposed on the upper side of the front face board as shown in FIG. 6. On a lateral side of the front face board 41 are disposed hanging sleeves 46 for the hanging hooks 14 of the main support 10 to pivotally fit therein. In addition, clip members 47 are disposed on inner side of the front face board 41 for detachably clipping the heating tube 30, whereby when the retaining cover 40 encloses the heating tube 30, the heating tube 30 is retained therein by the clip members 47. Latch members 48, 51 are disposed on the lateral bent board 42 and the back board 40' or the wall face for engaging the back board 40' with the front face board 41. Multiple hanging members 49 are disposed on inner side of the front face board 41 for hanging the articles to be dried thereon.

According to the above arrangements, in use, the articles to be dried are first hung on the heating tube 30 one by one and then the heating tube 30 is secured in the retaining cover 40. Then the back board 40' is engaged with the front face board 41 to close the retaining cover 40 and the heating tube 30 is powered on to dry the articles. The ambient space around the heating tube 30 is confined by the retaining cover 40 into a small half-closed area so that the air can only flow through the remaining passages such as the fan holes or the ventilating windows of the retaining cover. As a result, when heating, by means of the convection between cold and hot air, a quickly flowing air flow is naturally formed to enhance the drying effect. Moreover, by means of the half-closed retaining cover 40, the heat is fully conserved therein to remove the humid air. In addition, the ventilating devices 13 can be activated to drive the air flow so as to further enhance the drying effect. Accordingly, the energy for drying the articles is fully utilized so that the energy is saved and the drying time for the articles is shortened.

Figure 7:
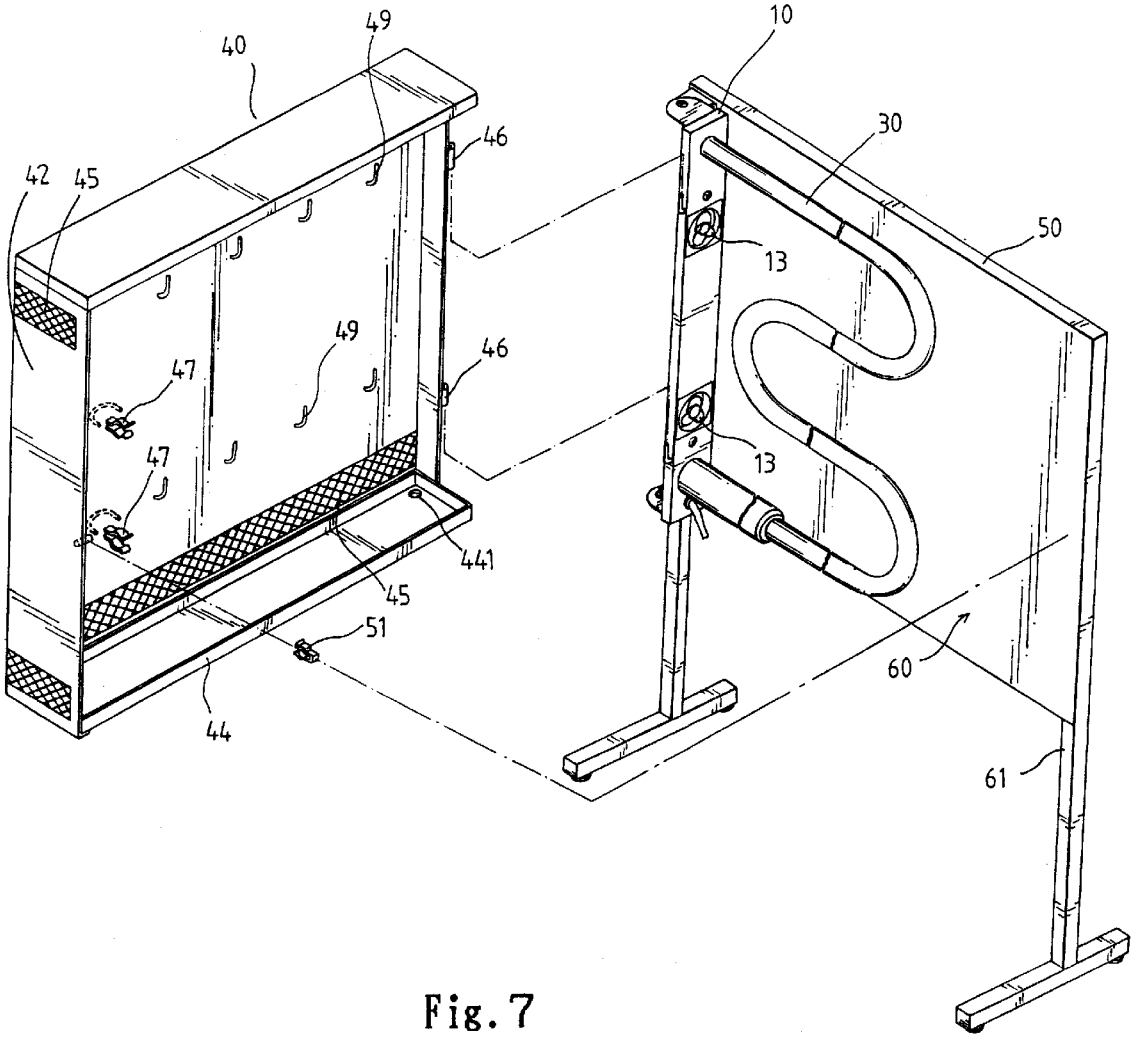
FIG. 7 is a perspective exploded view of a fourth embodiment of the present invention.

Referring to FIG. 7, in order to versatilely apply the present invention, the present invention can be installed on a movable stand 60 having supporting legs 61 and a wall board 50 for mounting the present invention thereon. Accordingly, the present invention can be conveniently used as an indoors used movable drying rack in different sites other than a wall face.

Figure 8:
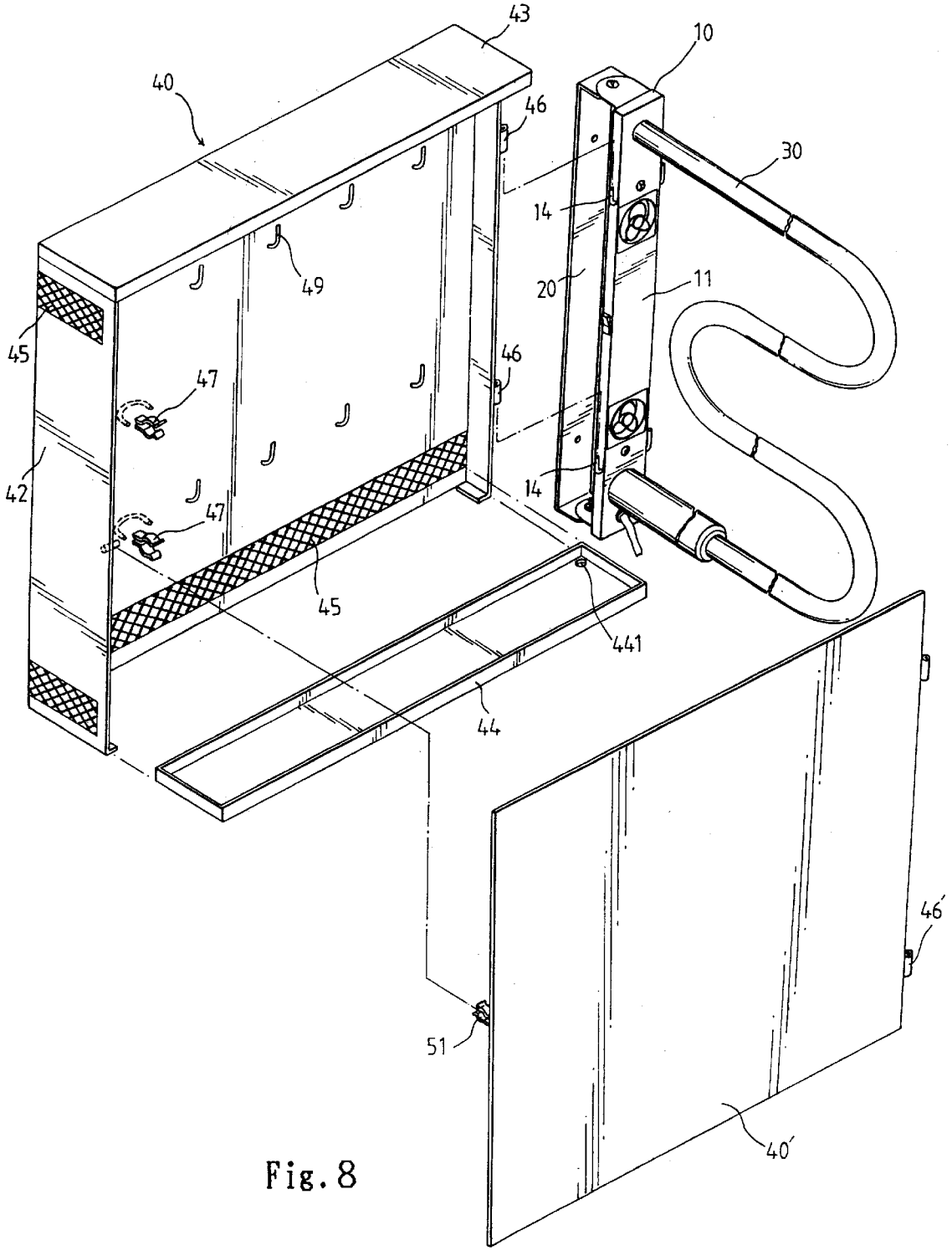
FIG. 8 is a perspective exploded view according to FIG. 7, showing another type of water tray.

When used indoors, in order to ensure that the water drops of the articles to be dried will not wet the floor, the water tray 44 serves to contain the dropping water. The water tray 44 is formed with draining holes 441 for draining the water. Alternatively, the water tray 44 can be designed as a drawer as shown in FIG. 8 for pouring the water.

The heating tube is firmly secured in and covered by the retaining cover so that the drying rack is well protected and the safety of the user is ensured.

It should be noted that the above description and accompanying drawings are only used to illustrate some embodiments of the present invention, not intended to limit the scope thereof. Any modification of the embodiments should fall within the scope of the present invention.

What is claimed is:

1. An electrothermal drying rack comprising a main support, a fixing board, a heating tube and a retaining cover, the main support including a hollow board member having lugs respectively at upper and lower ends, the heating tube being disposed on front side of the board member and connected to a power source for creating heating effect, said drying rack being characterized in that:

the fixing board is formed with lugs at upper and lower ends respectively for pivotally connecting with the lugs of the main support, hanging hooks being disposed on a lateral side of the board member for pivotally connecting with the retaining cover, the retaining cover including a half-closed cover body and a back board, the cover body including a front face board and a lateral bent board, on a lateral side of the front face board being disposed hanging sleeves for the hanging hooks of the main support to pivotally fit therein, clip members being disposed on inner side of the front face board for detachably clipping and securing the heating tube in the retaining cover, latch members being disposed on the lateral bent board and the back board for engaging the back board with the cover body.

2. A drying rack as claimed in claim 1, wherein ventilating devices are disposed on the front side of the main support.

3. A drying rack as claimed in claim 1, wherein a thermostat controlling switch is disposed on the power source of the heating tube.

4. A drying rack as claimed in claim 1, wherein a time setting switch is disposed on the power source of the heating tube.

5. A drying rack as claimed in claim 1, wherein a shade board is disposed on upper or lower side of the retaining cover.

6. A drying rack as claimed in claim 1, wherein a board member with a ventilating window is disposed on upper or lower side of the retaining cover.

7. A drying rack as claimed in claim 1, wherein a water tray is disposed on lower sides of the retaining cover.

8. A drying rack as claimed in claim 5, wherein a water tray is disposed on lower sides of the retaining cover.

9. A drying rack as claimed in claim 6, wherein a water tray is disposed on lower sides of the retaining cover.

10. A drying rack as claimed in claim 7, wherein the water tray is formed with a draining hole.

11. A drying rack as claimed in claim 8, wherein the water tray is formed with a draining hole.

12. A drying rack as claimed in claim 9, wherein the water tray is formed with a draining hole.

13. A drying rack as claimed in claim 7, wherein the water tray is designed as a drawer.

14. A drying rack as claimed in claim 8, wherein the water tray is designed as a drawer.

15. A drying rack as claimed in claim 9, wherein the water tray is designed as a drawer.

16. A drying rack as claimed in claim 10, wherein the water tray is designed as a drawer.

17. A drying rack as claimed in claim 11, wherein the water tray is designed as a drawer.

18. A drying rack as claimed in claim 12, wherein the water tray is designed as a drawer.

19. A drying rack as claimed in claim 1, wherein the drying rack is installed on a movable stand having supporting legs and a wall board for mounting the drying rack thereon.

* * * * *